US005591045A

United States Patent [19]

Pepe et al.

[11] Patent Number: 5,591,045

[45] Date of Patent: Jan. 7, 1997

[54] WIRE CONNECTING SYSTEM

[75] Inventors: Paul J. Pepe, Winston-Salem; Steven W. Puckett, Thomasville both of N.C.

[73] Assignee: The Whitaker Corporation, Wilmington, Del.

[21] Appl. No.: 443,964

[22] Filed: May 18, 1995

[51] Int. Cl.[6] ..... H01R 13/58

[52] U.S. Cl. ..... 439/460; 439/404

[58] Field of Search ..... 439/460, 404, 439/405, 399, 400, 499

[56] References Cited

U.S. PATENT DOCUMENTS

| | | | |
|---|---|---|---|
| 3,611,264 | 10/1971 | Ellis, Jr. | 339/99 R |
| 3,708,779 | 1/1973 | Enright et al. | 339/99 R |
| 3,798,587 | 3/1974 | Ellis, Jr. et al. | 339/97 P |
| 4,118,095 | 10/1978 | Berglund et al. | 339/99 R |
| 4,306,759 | 12/1981 | Norden | 439/404 |
| 4,533,196 | 6/1985 | Forberg et al. | 439/404 |
| 4,615,576 | 10/1986 | Gerke et al. | 439/404 |
| 4,693,539 | 9/1987 | Tighe, Jr. | 439/404 |
| 4,964,812 | 10/1990 | Siemon et al. | 439/403 |
| 5,409,404 | 4/1995 | Reed | 439/736 |

FOREIGN PATENT DOCUMENTS

| | | |
|---|---|---|
| 2414261 | 8/1979 | France . |
| 9318473 | 4/1994 | Germany . |

*Primary Examiner*—Gary F. Paumen

[57] ABSTRACT

This invention relates to a cross connect wiring block also known as a 110 connector system. This type of wiring block typically includes slotted beam contacts to electrically interconnect a set of first conductors to an associated set of second conductors. The wiring block essentially comprises an elongated housing containing plural cavities defined by opposing walls, where each cavity receives a slotted beam contact longitudinally positioned within the cavity. The improved features of this wiring block are the provision that each first conductor consists of a metal core and an outer layer of insulation, where the diameter of the conductor is a predetermined diameter, and that opposing walls of the cavities include plural pairs of longitudinally directed projections, where the distance between the projections of a given pair is less than the predetermined diameter. This ensures greater wire retention of the conductor. Further, the projections are so designed and arranged as to be compatible with conventional hand termination tools.

5 Claims, 5 Drawing Sheets

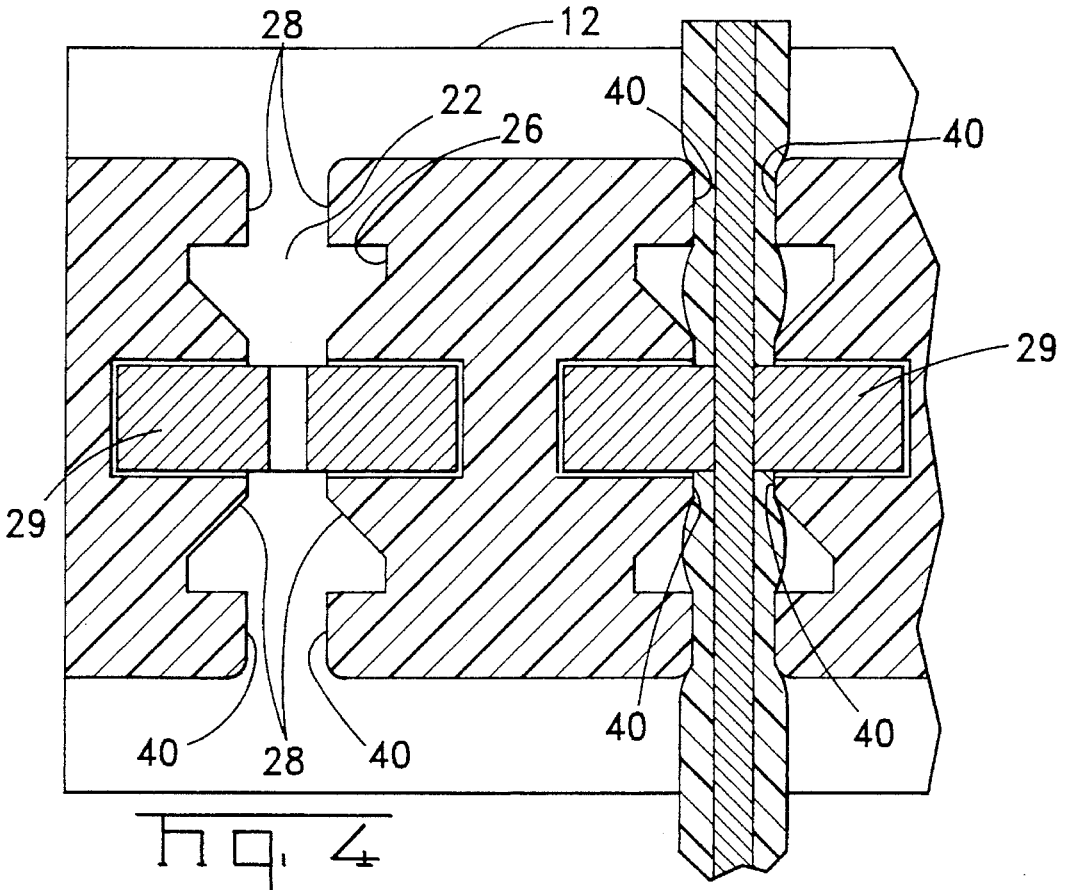
Fig. 4
Fig. 5
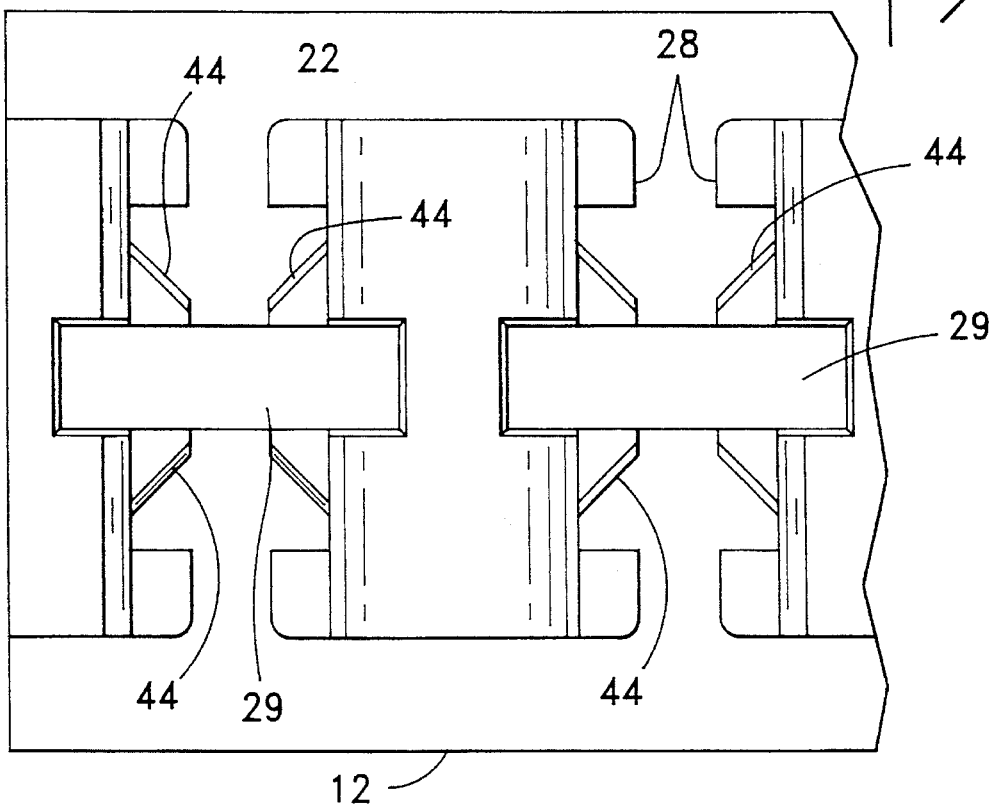

WIRE CONNECTING SYSTEM

BACKGROUND OF THE INVENTION

This invention relates to an improved wire connecting system, more precisely a wire connecting block, where a known commercial system is available and is sometimes identified as the 110 connector system. The present invention offers superior wire retention capabilities to those available in the market.

Such a wire connecting block is used in the telephone industry to electrically interconnect a set of first conductors to an associated set of second conductors. An early example of a wire connecting block is taught in U.S. Pat. No. 3,611,264. The connector thereof includes an indexing strip and a connecting block, the latter of which carries a plurality of slotted beam contacts. The indexing strip has a plurality of uniform height, spaced-apart teeth along its length. These teeth aid in indexing a first set of conductors. A corresponding plurality of uniform height, spaced-apart teeth carried by the connecting block serve to index a second set of conductors to be cross-connected through the slotted beam contacts to the first set of conductors.

The general design and operation of a 110 connector system have remained unchanged over the years to ensure compatibility with a commercially available, manual, wire termination tool, and existing telephone equipment. Two generally accepted tools to accomplish the termination process are the hand tools available through AT&T, Model No. Harris-Dracon D-814, and KRONE, Model No. LSA-PLUS No. 6417 2 055-01. Briefly, each such tool is designed to provide throughout essentially the width of the connector housing, a normal force to a strategically placed insulated wire, relative to the slotted beam contact, to insert same into the contact situated within the housing. It will be appreciated that a considerable normal force must be applied to the contact to effect termination thereto by the displacing of the conductor insulation, typically polyethylene and the like, and pushing such conductor into the slot between the contact arms. In the wire connecting blocks sold commercially, most experience considerable "play" in the seated contacts.

In a recently issued patent, U.S. Pat. No. 5,409,404, assigned to the assignee hereof, and which contents are incorporated herein by reference, there is described a system for eliminating contact play in the housing. Briefly, the connector housing is defined by a pair of side walls, having a plurality of through cavities, where the length of the cavities are characterized by a first uniform width over a portion of its length, a second portion having a uniform width greater than the first uniform width, and an angled wall transition portion between the uniform portions. The housing also includes a like plurality of thin walled sections along one of the side walls, where each of the thin walled sections is aligned with a corresponding angled wall transition portion within a given cavity. The slotted beam planar contact to be received therein comprises a mid body portion and a pair of opposing end portions each containing an insulation displacing slot for receiving a conductor. The mid body portion is provided with a lance struck therefrom and angled to abut the angled wall transition portion. By this arrangement the contact is secured against movement in a first direction as pressure is applied thereto during conductor termination. Further, the thin walled sections are partially severed from the respective side wall by a hand tool to allow hinging movement thereof into the respective cavities adjacent the lances. This action secures the contact against movement in a second direction, i.e. in the opposite direction during termination of the other set of conductors.

U.S. Pat. No. 4,964,812 is also directed to a system, though more complex and labor intense, for improving the retention of the contact within the housing body. The housing body is provided with retention means for positioning and retaining the slotted beam contacts. These retention means comprise retention posts which are flash molded onto the side of the housing body during the molding operation. Upon insertion and positioning of a plurality of beam contacts within the connecting block housing, pressure is exerted against the retention posts thereby breaking the flash molding and forcing the posts through positioning holes in the contacts. Thereafter, the post tips are peened in place providing permenent but free floating connection between the contacts and the connecting block housing.

While the foregoing represent needed improvements to the conventional wiring blocks, neither is concerned with improving the wire retention capabilities of a wiring block that remains compatible with existing termination tools. Such improved capabilities of this invention will become apparent to those skilled in the art from the following specification, particularly when read in conjunction with the accompanying drawings.

SUMMARY OF THE INVENTION

This invention is directed to a cross connect wiring block of the type for receiving slotted beam contacts to electrically interconnect a set of first conductors to an associated set of second conductors. The wiring block essentially comprises an elongated dielectric housing containing plural cavities defined by opposing walls, where each cavity receives a slotted beam contact longitudinally positioned within the cavity. An improved feature hereof is the provision of each first conductor consisting of a metal core and an outer layer of insulation, where the diameter of the conductor is a predetermined diameter. Further, the opposing walls include plural pairs of longitudinally directed projections, where the distance between the projections of a given pair is less than the predetermined diameter of the insulated conductors.

BRIEF DESCRIPTION OF THE DRAWINGS

FIG. 4 is a sectional view taken along line 4—4 of FIG. 3, further showing one terminated, insulated wire within a slotted beam contact.

FIG. 5 is a partial, enlarged top view of the system in accordance with this invention.

DETAILED DESCRIPTION OF THE PREFERRED EMBODIMENT

The invention, as described herein, relates to an improved wire connecting block of the type known in the art as the 110 connector system. The improved features hereof are the provision of increased wire retention, while being compatible with known termination tools, as hereinafter described and illustrated.

Figure 1:
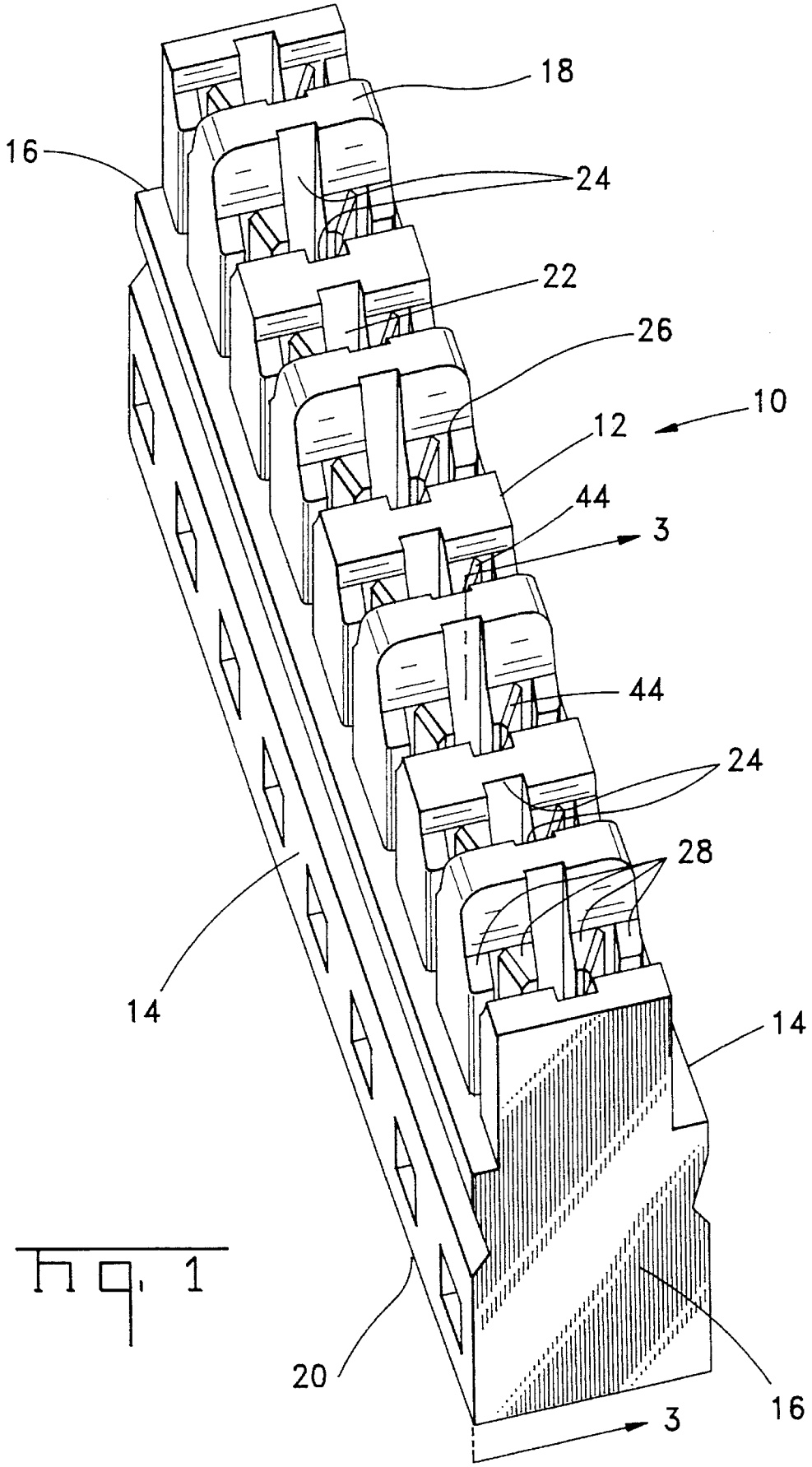
FIG. 1 is a perspective view of the improved wire connecting system according to this invention.
Figure 2:
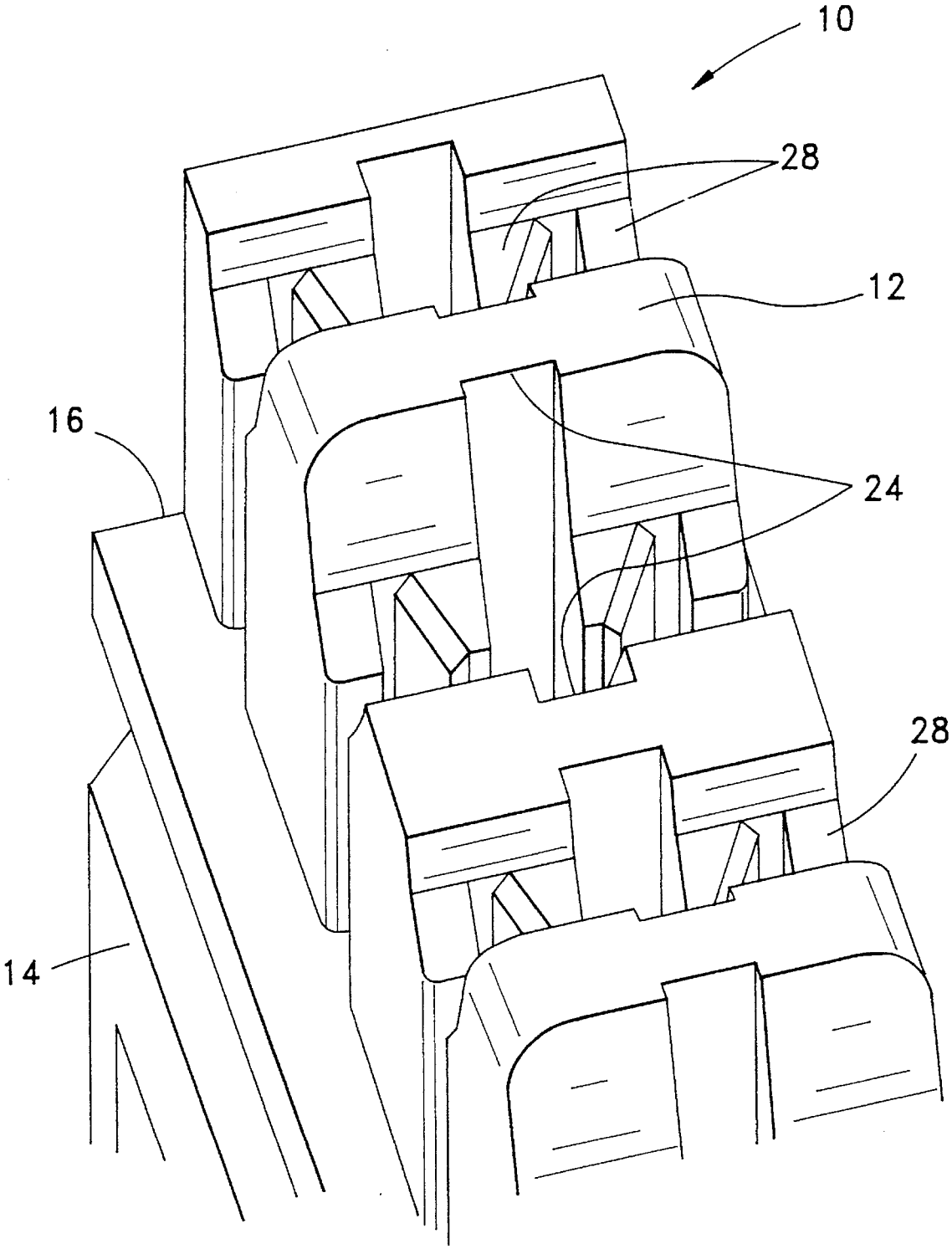
FIG. 2 is a partial, enlarged perspective view of the system of FIG. 1, illustrating further details of the invention.
Figure 3:
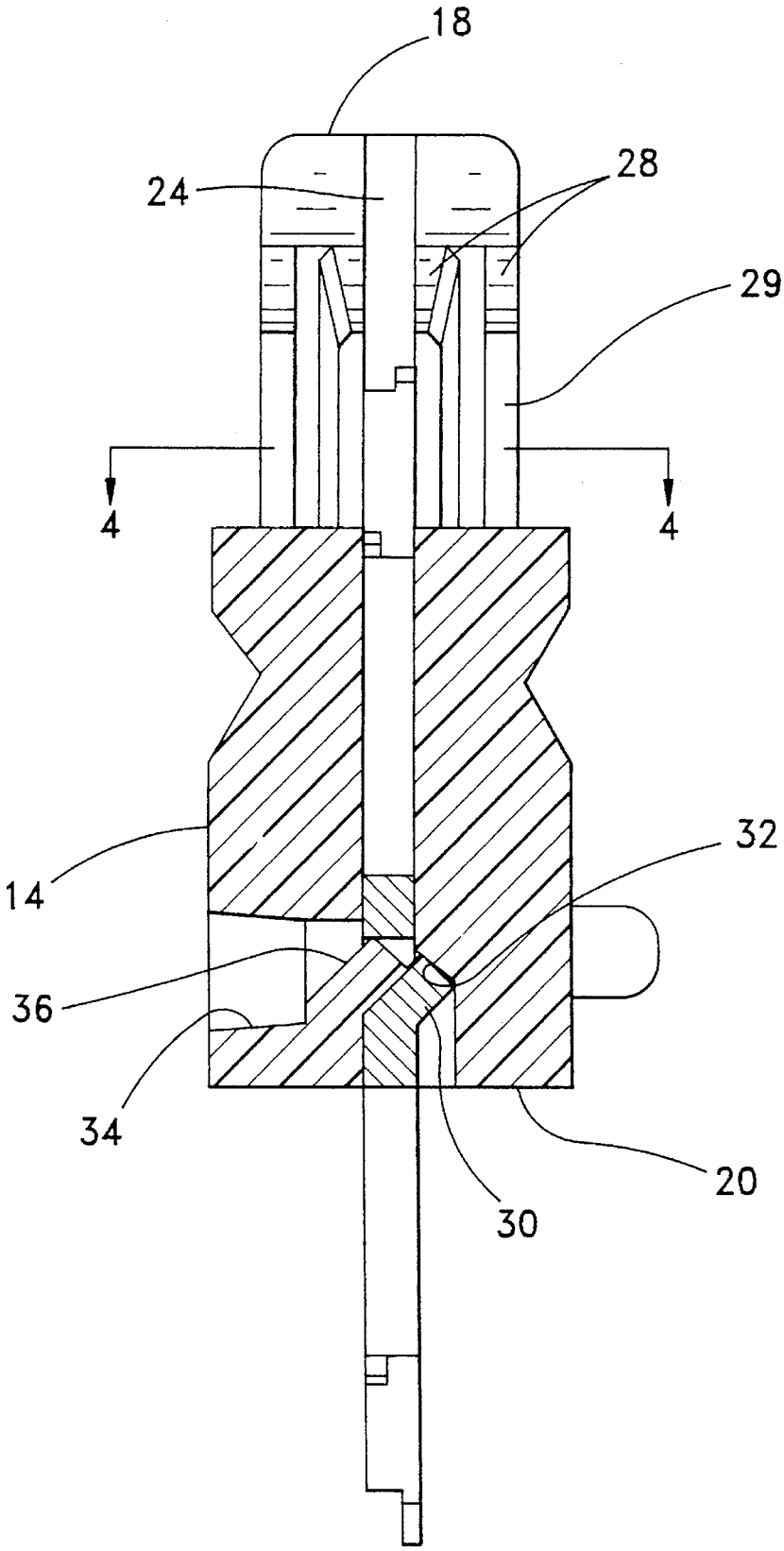
FIG. 3 is a sectional view of the system taken along line 3—3 of FIG. 1, but showing a loaded slotted contact within a cavity of such system.

Turning first to FIGS. 1 to 3, the wire connecting block 10 of this invention comprises a dielectric housing 12, typically formed of plastic, having a pair of side walls 14, a pair of end walls 16, a first mating face 18, and a contact loading face 20. Within the housing 12 are a plurality of cavities 22 for receiving and retaining slotted beam planar contacts, as hereinafter described. The cavities along the mating face 18, include a pair of opposing slots 24 into which the slotted beam contacts are received in a longitudinally arranged manner. Additionally, on each side wall 26 of the cavity 22, spaced from said slots 24, are plural pairs of opposing projections or vertically oriented ribs 28. The function of such projections or ribs will be discussed in greater detail hereinafter.

Before describing further details of the housing 12, it may be helpful to review briefly the construction of a slotted beam contact 29, to illustrate in conjunction with FIG. 3, how such contact is retained within the housing. For a detailed discussion of a preferred slotted beam contact, reference may be made to U.S. Pat. No. 5,409,404. Briefly, slotted beam contacts are typically stamped from a planar strip of sheet metal, such as phosphor bronze, by an operation which advances the strip incrementally through a plurality of work stations, where stamping and peening steps may be performed on the strip. The resulting contact consists of a mid body portion, and a pair of insulation cutting and conductor receiving slots formed by a pair of arms extending from the mid body portion. The pair of arms are typically bifurcated to form furcations with inner portions forming enlarged elongated openings adjacent the mid body portion, where the terminated conductors seat, and with outer portions closing towards each other to form slots having predetermined width characteristics for receiving insulated conductors. Further, the outermost ends of the arms are tapered to form a relatively sharp V-shaped entrance to the conductor receiving slots to thereby facilitate displacement of the insulation and termination of the conductor.

Since contact retention and avoidance of "play" are key elements to an effective wire connecting block, the contact may be modified by the provision of an outwardly directed lance. Specifically, as a further operation of the stamping process, a lance 30 is struck from the mid body portion of the contact, where such lance 30 is acutely angled from the mid body portion. In loading the housing 12, the lance 30 is caused to rest against the angled transition section 32, see FIG. 3. In other words, such angled section functions as a "stop" to further movement of the contact toward the mating face 18.

Provision must also be made to prevent movement of the contact toward the contact loading face 20. It will be noted from FIGS. 1 and 3 that a recess 34 has been provided in a side wall 14, where the base 36 (FIG. 3) is a relatively thin section. To finally secure the contact, a sharp tool may be caused to enter into the recess 34 where such tool severs three sides of the thin walled section 36 which is then hingedly moved or flexed into the opening created by the lance 30. By this arrangement, the partially severed hinged wall section 36 is flexed into engagement with the lance 30, and thereby positioned to resist movement of the contact in the opposite direction. In other words, "stops" have been created against movement in either of the directions where the forces of conductor termination are significant.

Figure 6:
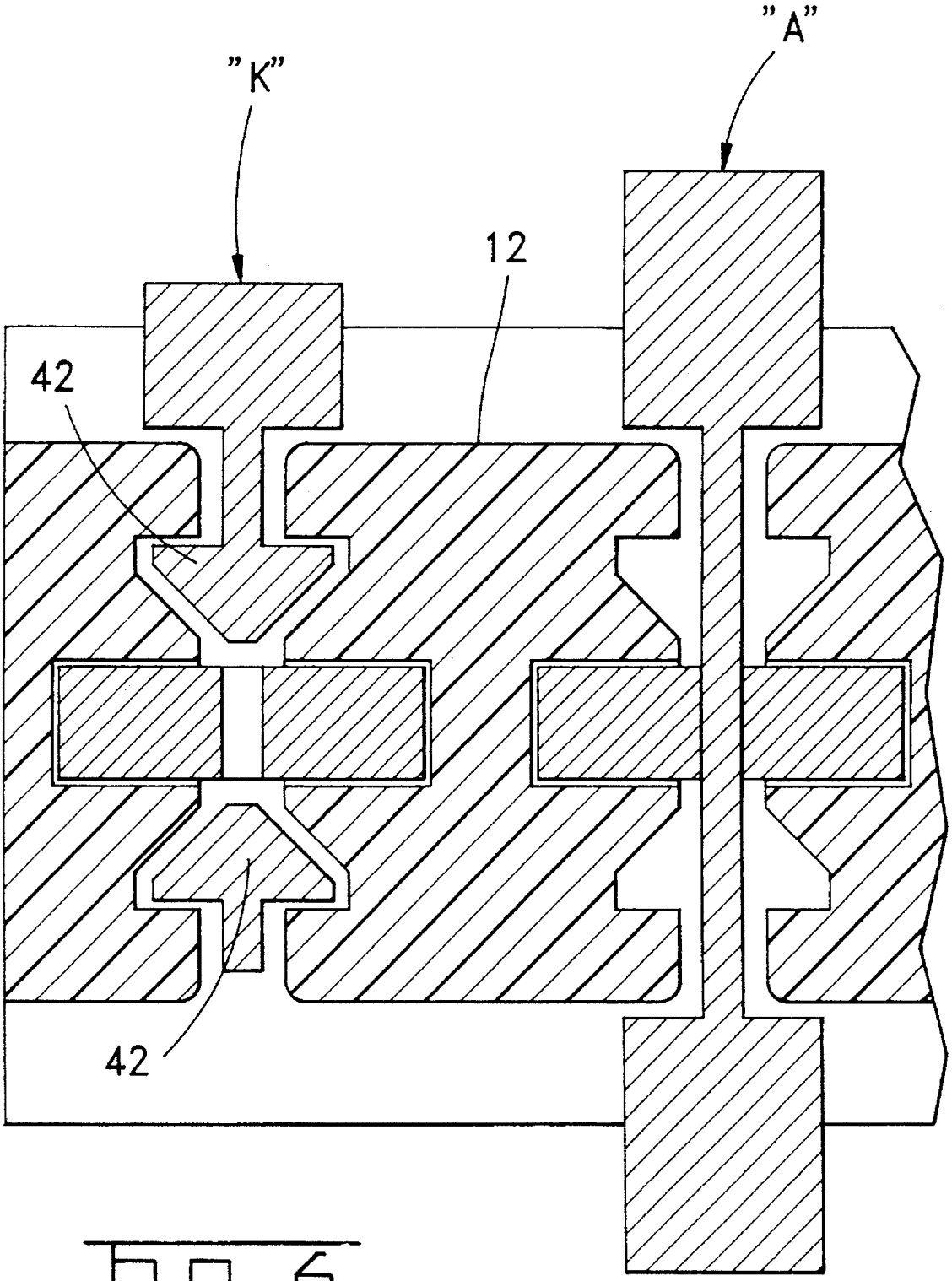
FIG. 6 is a partial, enlarged sectional view of the system hereof, illustrating the profile of two known terminating tools, and their relationship to the unique features of this invention.

Returning now to FIG. 2, and the further illustrations of FIGS. 4 to 6, which show clearly the unique features of this invention, it will be recalled that plural pairs of opposing projections or vertically oriented ribs 28 have been provided along the cavity walls 26. Each pair consists of projections 28 directed inwardly toward a complementary projection along the opposite cavity wall 26. The spacing between projection ends 40 of a given pair is slightly less than the diameter of the insulated wire to be terminated within the cavity 22, note in particular the terminated wire in FIG. 4. By this arrangement multiple gripping fingers are provided to increase wire retention. By way of example, a series of tests were conducted on the wire retention capabilities of a wire connecting system according to this invention, and a prior art version having no cavity projections but rather relying on the retentive capabilities of the slotted beam contact. In this series of tests, the average wire retention force, or the force to remove the wire in pounds per inch, was 1.81 for the present invention, versus 1.27 for the prior art.

While a feature of this invention is the provision of greater wire retention capabilities, such feature is only part of the unique marketability of the product covered by this invention. It will be recalled from the earlier discussion that there are two commercial hand tools that are widely used today to effect termination of a 110 type wiring block. A wire connecting block that is compatible with each offers significant commercial advantages to the manufacturer, as well as some peace of mind to the user. In any case, the respective tools are hand grippable in a pliers-like fashion, where the working heads are configured to be received in the housing cavity 22, and for urging the insulated wire into the slotted beam contact. The cross-sections of the different working heads are illustrated in FIG. 6, where the KRONE tool is identified as "K" and the AT&T tool identified as "A". With each tool, the working heads essentially traverse the width of the housing 12 to provide a uniform normal force to the underlying insulated wire that is being terminated.

In the preferred embodiment, as best illustrated in FIGS. 4 to 6, the respective outer pairs of the axially oriented cavity projections 28 are generally rectangular in cross-section, whereas the inner pairs of projections are triangular in cross-section. By this arrangement, a continuous transverse slot is provided to receive the "A" tool, while at the same time ample space is available to receive the opposing uniquely shaped arrow heads 42 of the "K" tool. Further, to facilitate the entry of the arrow heads 42 into the cavity 22, the top edges of the respective projections 28, at least the inner edges, are tapered or beveled 44, see FIG. 5. These beveled edges help to align and direct the arrow heads into the cavity 22.

We claim:

1. A cross connect wiring block for electrically connecting a set of first conductors each having a predetermined diameter to an associated set of second conductors, the wiring block comprising:

an elongated housing containing plural cavities defined by opposing walls, a slotted beam contact disposed within each said cavity for electrically engaging a respective one of the first conductors, and each said cavity including four pairs of projections, the projections of each said pair extending toward each other from respective ones of said opposing walls, wherein a distance between the projections of each said pair is less than said predetermined diameter.

2. The cross connect wiring block according to claim 1, wherein top edges of said projections are tapered downwardly to facilitate termination of said first conductors to said slotted beam contacts.

3. The cross connect wiring block according to claim 1, wherein the respective cavities include two outer pairs of said projections each having an essentially rectangular cross-section, and two inner pairs of said projections each having an essentially triangular cross-section and a side which is angled from its respective said wall of said cavity.

4. The cross connect wiring block according to claim 3, wherein a top edge of each said angled side is tapered to ensure alignment of a conductor termination tool into said cavity.

5. The cross connect wiring block according to claim 3, wherein a profile of said cavity between adjacent said pairs of projections is essentially an arrow head configuration.

* * * * *